US006382429B1

(12) United States Patent
Yeh et al.

(10) Patent No.: US 6,382,429 B1
(45) Date of Patent: May 7, 2002

(54) ADAPTER FOR DISPENSING RACK FOR T-SHIRT STYLE BAGS WITH RUPTURABLE TAB OPENING

(75) Inventors: Ron C. Yeh, Morganville; Ben Tseng, East Brunswick, both of NJ (US)

(73) Assignee: Inteplast Group, Ltd., Livingston, NJ (US)

( * ) Notice: Subject to any disclaimer, the term of this patent is extended or adjusted under 35 U.S.C. 154(b) by 0 days.

(21) Appl. No.: 09/829,205

(22) Filed: Apr. 9, 2001

(51) Int. Cl.[7] ..... A47F 5/00; B65D 33/14

(52) U.S. Cl. ..... 211/59.1; 211/183; 211/50; 248/95; 206/554

(58) Field of Search ..... 211/50, 59.1, 57.1, 211/183; 248/95, 99, 100; 206/554

(56) References Cited

U.S. PATENT DOCUMENTS

| | | | | | |
|---|---|---|---|---|---|
| 4,981,216 | A | * | 1/1991 | Wilfong | 206/554 |
| 5,323,909 | A | * | 6/1994 | Piraneo et al. | 206/554 |
| 5,667,173 | A | * | 9/1997 | Wilfong et al. | 248/100 |
| 5,941,392 | A | * | 8/1999 | Huang et al. | 206/554 |
| 5,979,841 | A | * | 11/1999 | Piraneo et al. | 248/95 |
| 6,089,514 | A | * | 7/2000 | Huang et al. | 248/95 X |
| 6,264,035 | B1 | * | 7/2001 | Petrie | 206/554 |

* cited by examiner

*Primary Examiner*—Robert W. Gibson, Jr.
(74) *Attorney, Agent, or Firm*—David A. Belasco; Beehler & Pavitt

(57) ABSTRACT

An adapter for use with dispensing racks having a central mounting hook and T-shirt style bags with tab openings providing a rupturable portion of the tab between the tab opening and the bag mouth is described. The adapter includes a hollow body with a cavity that is sized and shaped to fit frictionally over the central mounting hook. The body has a front surface, a top surface, a bottom surface, first and second side edges and a back surface. The back surface includes a vertically oriented tearing ridge. The adapter's cavity is fitted over the central mounting hook with the front surface facing a direction in which the support arms extend. When a pack of T-shirt style bags that have the tab opening with a rupturable portion mounted on the support arms with the tab openings of the bags placed over the adapter, the tearing ridge will serve to facilitate tearing the rupturable portion of the mounting tab as a bag is removed from the dispensing rack so that the mounting tab will remain attached to the bag. Variations of the adapter include bodies with rounded top surfaces and tapered side edges, bodies with a vertical channel and bodies with an opening into the channel. Other variants include adapters that include a transverse channel in the bottom surface of the body for use on dispensing racks having a horizontal rod supporting the central mounting hook.

11 Claims, 5 Drawing Sheets

Fig 4A
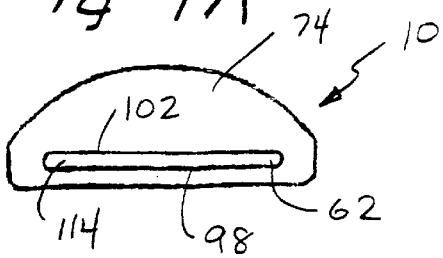
Fig. 6
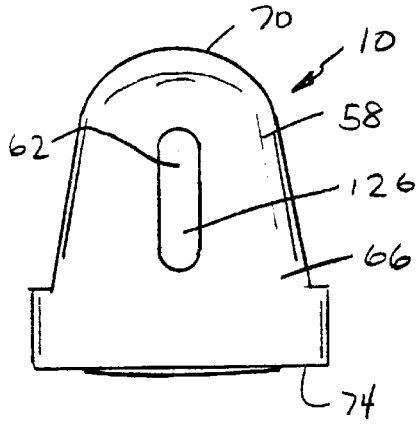
Fig. 5
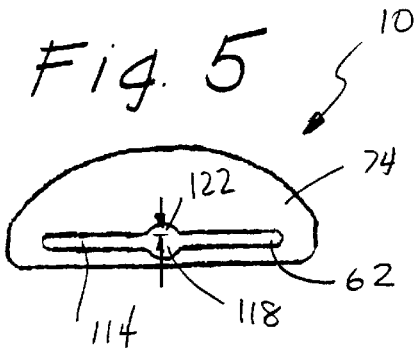
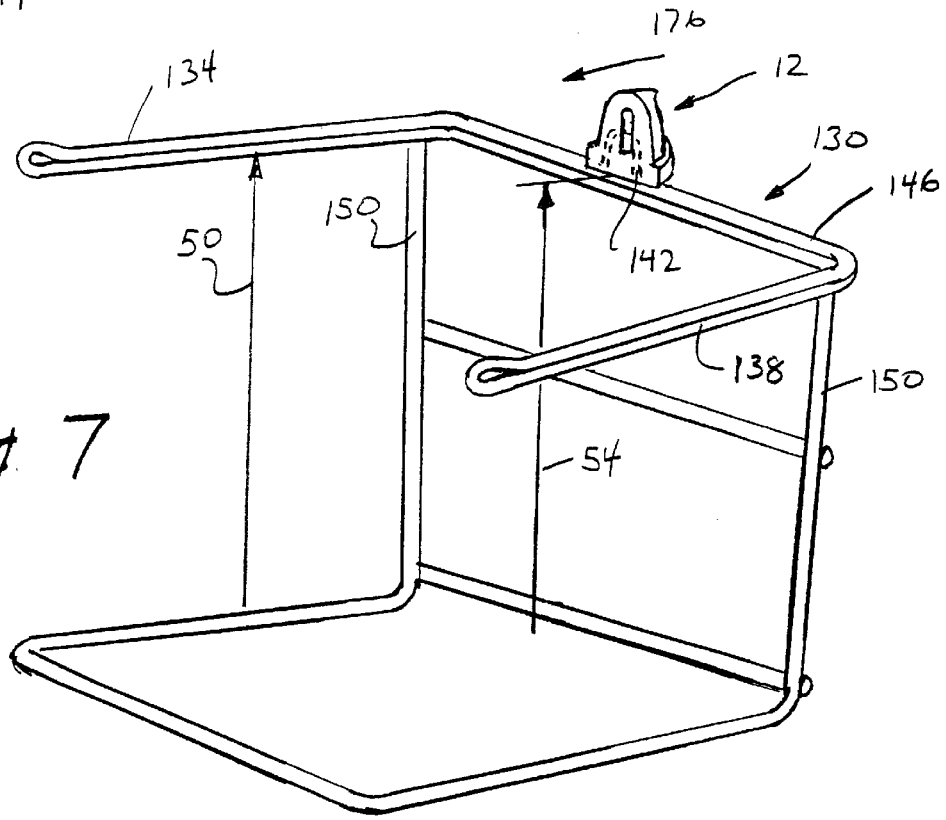
Fig 7

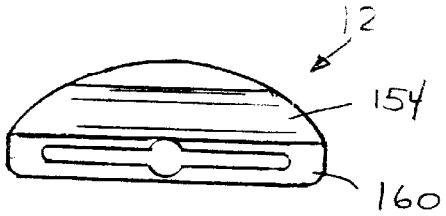
Fig. 8
Fig. 8A
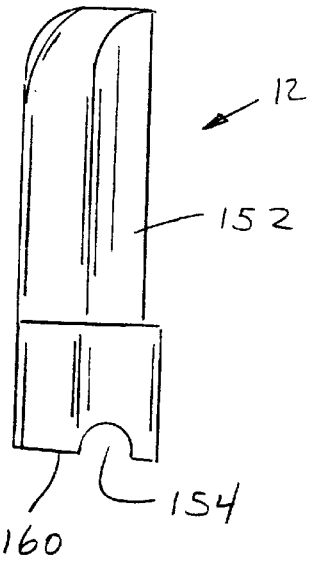
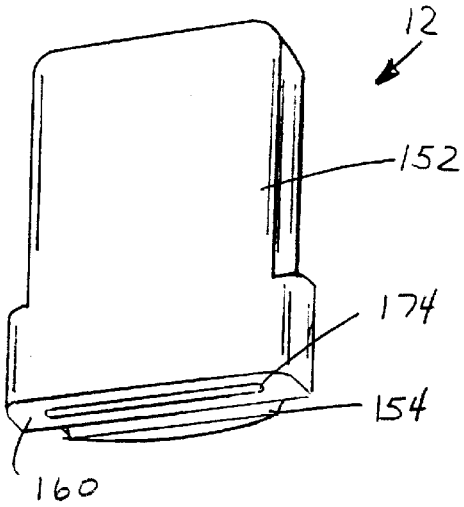
Fig. 9
Fig. 10
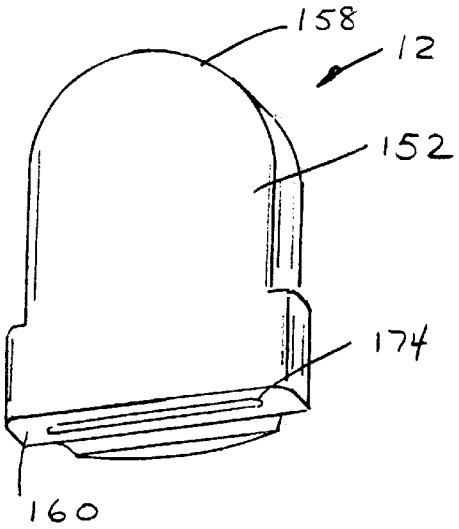

ADAPTER FOR DISPENSING RACK FOR T-SHIRT STYLE BAGS WITH RUPTURABLE TAB OPENING

FIELD OF INVENTION

The invention pertains to plastic shopping bags. More particularly, the invention relates to an adapter for use with dispensing racks for expandable plastic film gusseted bags having integral carrying handles.

BACKGROUND OF THE INVENTION

Expandable plastic film gusseted bags with integral carrying handles, commonly known as T-shirt bags, have been used with vertical mounting racks for some time. Some varieties of these T-shirt bags include a central mounting tab that includes a slit or opening. This mounting tab is disposed over a mounting hook on the rack and used in conjunction with openings in the upper portion of the bag handles to mount the back to the rack. The central mounting tab further serves to constrain the rear wall of bag as it is pulled from the rack so that the bag will open. Typically, the bags employing this type of central mounting tab include a perforation line below the slit or opening in the bag to allow the mounting tab to be torn from the bag as it is removed from the rack, leaving the torn off tab on the mounting hook.

T-shirt style bags have been developed incorporating a rupturable tab opening that includes an upwardly curving cut extending from the slit or opening or similar feature to facilitate tearing the tab upon removal from the rack. In this way, the tab will remain attached to the bag preventing the necessity of removing a wad of bag tabs from the rack when the rack is to be refilled. The present invention may be easily added to current racks designed for such special tab opening T-shirt bags and is designed to facilitate tearing of the upwardly curving cut extending from the slit so that less force and effort is necessary to effect such tearing.

Various designs have been developed for rack mounted bags and dispensers for such bags, incorporating a number of different technologies. U.S. Pat. No. 5,562,580 issued to Beasley et al. describes a self-opening polyethylene bag stack having a central mounting tab. The mounting tab includes a tear-off slit below the mounting slit. Bags of this design leave the mounting tab affixed to the mounting hook of the dispenser when the bag is removed.

U.S. Pat. No. 5,269,605 issued to Nguyen discloses a T-shirt style shopping bag with central mounting tab. The mounting tab includes an upwardly angled mounting slit. The slit is designed to tear upon removal of a bag from the rack. No portion of the mounting tab will remain on the rack when the slit is ruptured.

U.S. Pat. No. 5,188,235 issued to Pierce et al. describes a bag pack including a central mounting tab. The mounting tab includes a mounting slit having a pair of upward curving slits extending toward the bag mouth. The upward curving slits provide means for rupturing the mounting slit upon removal of the bag from a rack, thus leaving no protion of the mounting tab on the rack.

U.S. Pat. No. 5,346,310 also issued to Nguyen discloses a T-shirt style shopping bag with central mounting tab. This mounting tab includes a curved mounting slit that begins in the center of the tab and terminates close to an edge of the tab nearest the bag mouth. This bag is also designed to leave no portion of the mounting tab on the dispensing rack.

U.S. Pat. No. 5,979,655 issued to Tseng et al., discloses a plastic bag stack with a tab opening that incorporates an upwardly curving cut extending from the slit in the mounting tab that can be most easily torn by the adapter. Other designs of t-shirt style bags incorporating a rupturable central mounting tab can also be used with the adapter.

While other variations exist, the above-described designs for roll mounted bags and dispensers are typical of those encountered in the prior art.

It is an objective of the present invention to provide a T-shirt type produce bag that can be mounted on a continuous roll. It is a further objective to provide such a bag that can be easily and inexpensively manufactured in a variety of sizes. It is a still further objective of the invention to provide a bag that can be easily opened. It is yet a further objective to provide for bags that a user can easily identify as to the open end. In is another objective of the invention to provide a dispenser that can conveniently store the bags and that can separate the bags upon dispensing. Finally, it is an objective of the invention that the dispenser be capable of opening the bags for the user.

While some of the objectives of the present invention are disclosed in the prior art, none of the inventions found include all of the requirements identified. The present invention addresses many of the deficiencies of prior art roll mounted bags and dispensers and satisfies all of the objectives described above.

SUMMARY OF THE INVENTION

An adapter for a dispensing rack for T-shirt style bags with tab openings providing a rupturable portion of the tab between the tab opening and the bag mouth including the desired features may be constructed from the following components. The dispensing rack for use with such bags includes first and second support arms, a central mounting hook disposed between the support arms, and means for maintaining the support arms at a first predetermined elevation and the mounting hook at a second predetermined elevation. The adapter includes a hollow body. The body includes a cavity that is sized and shaped to fit frictionally over the central mounting hook.

The body has a front surface, a top surface, a bottom surface, first and second side edges and a back surface. The back surface includes a vertically oriented tearing ridge. The adapter's cavity is fitted over the central mounting hook with the front surface facing a direction in which the support arms extend. When a pack of T-shirt style bags that have the tab opening with a rupturable portion mounted on the support arms with the tab openings of the bags placed over the adapter, the tearing ridge will serve to facilitate tearing the rupturable portion of the mounting tab as a bag is removed from the dispensing rack so that the mounting tab will remain attached to the bag.

In a variant of the invention, the top surface of the adapter is rounded to facilitate mounting the tab openings of the bags over the adapter.

In a further variant, the first and second side edges of the adapter taper upwardly toward the top surface to facilitate mounting the tab openings of the bags over the adapter. These tapered side edges also serve to direct the vertically oriented tearing ridge into the rupturable portion of the mounting tab as bags are mounted on the dispensing rack.

In still a further variant, the cavity of the adapter includes a front wall, a back wall, first and second side walls and a top wall. A vertical channel extends from the bottom surface to the top wall and penetrates for a first predetermined depth into the front wall and the back wall of the cavity. When the adapter is installed over the central mounting hook of the dispensing rack, the vertical channel will facilitate such installation.

In another variant of the invention, the hollow body of the adapter includes an opening. The opening penetrates from the front surface to the cavity and serves to release air pressure as the adapter is fitted over the central mounting hook.

In still another variant, an adapter is designed for use with a dispensing rack that first and second support arms, a central mounting hook disposed between the support arms, a horizontal rod connecting the first and second support arms and the central mounting hook and means for maintaining the support arms at the first predetermined elevation and the mounting hook at the second predetermined elevation.

The adapter includes a hollow body having a cavity. The cavity is sized and shaped to fit frictionally over the central mounting hook. The body has a front surface, a top surface, a bottom surface, first and second side edges and a back surface. The back surface includes a vertically oriented tearing ridge. When the adapter's cavity is fitted over the central mounting hook with the front surface facing a direction in which the support arms extend and a pack of T-shirt style bags having the tab opening with a rupturable portion are mounted on the support arms with the tab openings of the bags located over the adapter, the tearing ridge will serve to facilitate tearing the rupturable portion of the mounting tab as a bag is removed from the dispensing rack so that the mounting tab will remain attached to the bag.

In yet another variant, the adapter includes a transverse channel. The transverse channel is parallel to the bottom surface of the body and is sized and shaped to fit frictionally over the horizontal rod connecting said first and second support arms and the central mounting hook. When the adapter is installed over the central mounting hook the transverse channel will engage the horizontal rod, thereby further stabilizing the adapter upon the dispensing rack.

In still a further variant of the invention, the top surface of the body is rounded to facilitate mounting the tab openings of the bags over the adapter. In yet a further variant, the first and second side edges of the body taper upwardly toward a top surface to facilitate mounting the tab openings of the bags over the adapter and to direct a vertically oriented tearing ridge into the rupturable portion of the mounting tab as bags are mounted on the dispensing rack.

In still another variant a cavity in the adapter includes a front wall, a back wall, first and second side walls and a top wall. A vertical channel extends from the bottom surface of the body to the top wall and penetrates for a first predetermined depth into the front wall and the back wall of the cavity. When the adapter is installed over the central mounting hook of the dispensing rack, the vertical channel will facilitate such installation.

In a final variant of the invention, the adapter includes an opening. The opening penetrates from the front surface of the body to the cavity and serves to release air pressure as the adapter is fitted over the central mounting hook.

DESCRIPTION OF THE DRAWINGS

FIG. 4A is a bottom view of the FIG. 4 embodiment;

FIG. 5 is a bottom view of a fourth embodiment of the adapter having a vertical channel penetrating the front and back walls of the cavity;

FIG. 6 is a rear view of a fifth embodiment of the adapter having an opening in the front surface of the body;

FIG. 7 is a dispensing rack having a horizontal rod that supports an adapter;

FIG. 8 is a bottom view of a sixth embodiment of the adapter having transverse channel in the bottom surface of the body;

FIG. 8A is a side view of the FIG. 8 embodiment;

FIG. 9 is a perspective view of the FIG. 8 embodiment illustrating the cavity;

FIG. 10 is a perspective view of a seventh embodiment of the adapter with the body having a rounded top surface;

DETAILED DESCRIPTION OF THE PREFERRED EMBODIMENT

Figure 1:
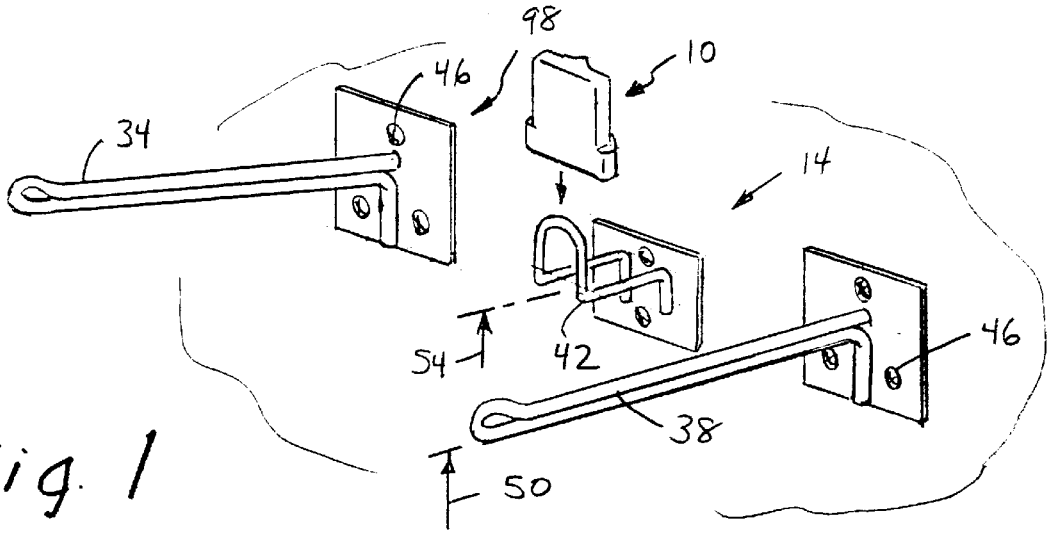
FIG. 1 is a perspective view of a dispensing rack with an adapter suitable for use with T-shirt style bags having a central mounting tab with a rupturable portion between the mounting tab and the open bag mouth.
Figure 1A:
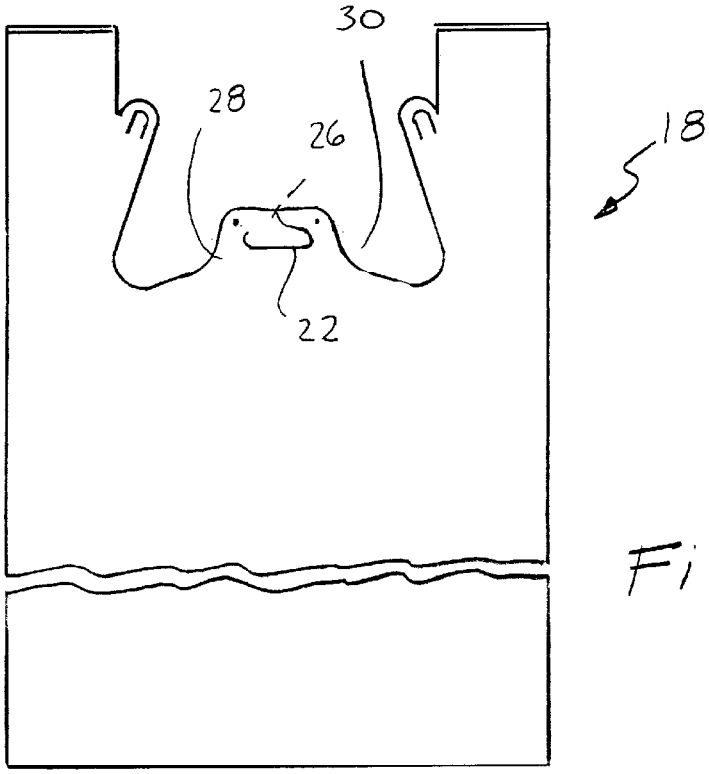
FIG. 1A is plan view of a T-shirt style bag suitable for use with the adapter of the FIG. 1 and FIG. 7 dispensing racks.
Figure 2:
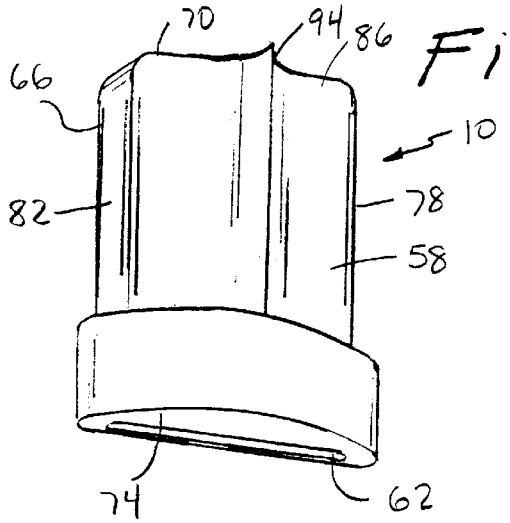
FIG. 2 is a perspective view of a first embodiment of the adapter.

FIGS. 1 and 2 illustrate an adapter 10 for a dispensing rack 14 for T-shirt style bags 18, as illustrated in FIG. 1A, with tab openings 22 providing a rupturable portion 26 of the tab 28 between the tab opening 22 and the bag mouth 30, as illustrated in FIG. 1A, including the desired features that may be constructed from the following components. The dispensing rack 14 for use with such bags 18 includes first 34 and second 38 support arms, a central mounting hook 42 disposed between the support arms 34, 38, and means 46 for maintaining the support arms 34, 38 at a first predetermined elevation 50 and the mounting hook 42 at a second predetermined elevation 54. As illustrated in FIG. 2, the adapter 10 includes a hollow body 58. The body 58 includes a cavity 62 that is sized and shaped to fit frictionally over the central mounting hook 42.

The body 58 has a front surface 66, a top surface 70, a bottom surface 74, first 78 and second 82 side edges and a back surface 86. The back surface 86 includes a vertically oriented tearing ridge 94. The adapter's 10 cavity 62 is fitted over the central mounting hook 42 with the front surface 66 facing a direction 98 in which the support arms 34, 38 extend. When a pack of T-shirt style bags 18 that have the tab opening 22 with a rupturable portion 26 mounted on the support arms 34, 38 with the tab openings 22 of the bags 18 placed over the adapter 10, the tearing ridge 94 will serve to facilitate tearing the rupturable portion 26 of the mounting tab 28 as a bag 18 is removed from the dispensing rack 14 so that the mounting tab 28 will remain attached to the bag 18.

Figure 3:
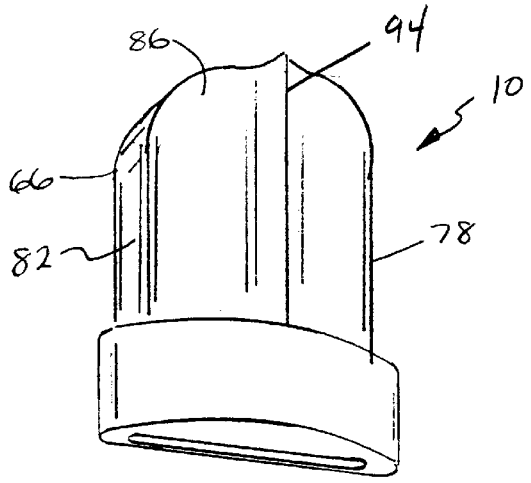
FIG. 3 is a perspective view of a second embodiment of the adapter having a rounded top.

In a variant of the invention, as illustrated in FIG. 3 the top surface 70 of the adapter 10 is rounded to facilitate mounting the tab openings 22 of the bags 18 over the adapter 10.

Figure 4:
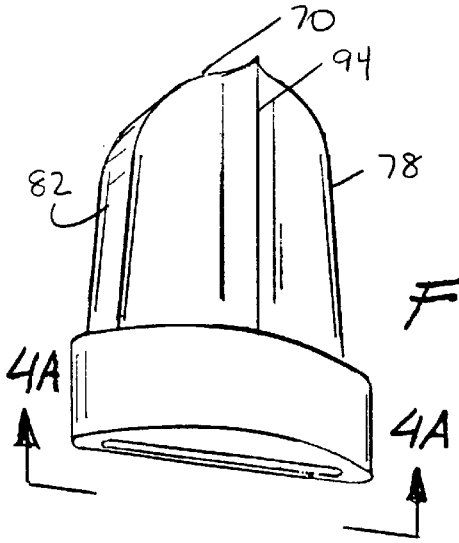
FIG. 4 is a perspective view of a third embodiment of the adapter having taper side edges.

In a further variant, as illustrated in FIG. 4, the first 78 and second 82 side edges of the adapter 10 taper upwardly toward the top surface 70 to facilitate mounting the tab openings 22 of the bags 18 over the adapter 10. These tapered side edges 78, 82 also serve to direct the vertically oriented tearing ridge 94 into the rupturable portion 26 of the mounting tab 28 as bags 18 are mounted on the dispensing rack 14.

In still a further variant, as illustrated in FIG. 4A, the cavity 62 of the adapter 10 includes a front wall 98, a back wall 102, first 106 and second 110 side walls and a top wall 114. In yet a further variant, as illustrated in FIG. 5, a vertical channel 118 extends from the bottom surface 74 to the top wall 114 and penetrates for a first predetermined depth 122 into the front wall 98 and the back wall 102 of the cavity 62. When the adapter 10 is installed over the central mounting hook 42 of the dispensing rack 14, the vertical channel 118 will facilitate such installation.

In another variant of the invention, as illustrated in FIG. 6, the hollow body 58 of the adapter 10 includes an opening 126. The opening 126 penetrates from the front surface 66 to the cavity 62 and serves to release air pressure as the adapter 10 is fitted over the central mounting hook 42.

In still another variant, as illustrated in FIGS. 7–13, an adapter 12 is designed for use with a dispensing rack 130, as illustrated in FIG. 7, that has first 134 and second 138 support arms, a central mounting hook 142 disposed between the support arms 134, 138, a horizontal rod 146 connecting the first 134 and second 138 support arms and the central mounting hook 142 and means 150 for maintaining the support arms 134, 138 at the first predetermined elevation 50 and the mounting hook at the second predetermined elevation 54.

The adapter 12 includes a hollow body 152 having a cavity 174. The cavity 174 is sized and shaped to fit frictionally over the central mounting hook 142. The body 152 has a front surface 156, a top surface 158, a bottom surface 160, first 162 and second 166 side edges and a back surface 168. The back surface 168 includes a vertically oriented tearing ridge 170. When the adapter's cavity 174 is fitted over the central mounting hook 142 with the front surface 156 facing a direction 176 in which the support arms 134, 138 extend and a pack of T-shirt style bags 18 having the tab opening 22 with a rupturable portion 26 are mounted on the support arms 134, 138 with the tab openings 22 of the bags 18 located over the adapter 12, the tearing ridge 170 will serve to facilitate tearing the rupturable portion 26 of the mounting tab 28 as a bag 18 is removed from the dispensing rack 130 so that the mounting tab 28 will remain attached to the bag 18.

In yet another variant, the adapter 12, as illustrated in FIGS. 8, 8A and 9, includes a transverse channel 154. The transverse channel 154 is parallel to the bottom surface 160 of the body 152 and is sized and shaped to fit frictionally over the horizontal rod 146 connecting said first 134 and second 138 support arms and the central mounting hook 142. When the adapter 12 is installed over the central mounting hook 142 the transverse channel 154 will engage the horizontal rod 146, thereby further stabilizing the adapter 12 upon the dispensing rack 130.

Figure 11:
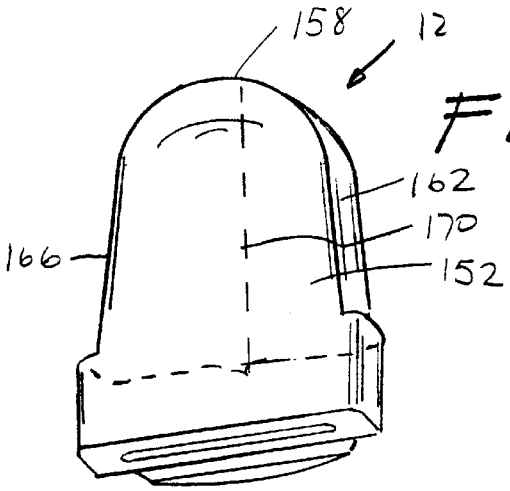
FIG. 11 is a perspective view of an eighth embodiment of the adapter with the body having tapered side edges.

In still a further variant of the invention, as illustrated in FIG. 10, the top surface 158 of the body 152 is rounded to facilitate mounting the tab openings 22 of the bags 18 over the adapter 12. In yet a further variant, as illustrated in FIG. 11, the first 162 and second 166 side edges of the body 152 taper upwardly toward the top surface 158 to facilitate mounting the tab openings 22 of the bags 18 over the adapter 12 and to direct the vertically oriented tearing ridge 170 into the rupturable portion 26 of the mounting tab 28 as bags 18 are mounted on the dispensing rack 130.

Figure 12:
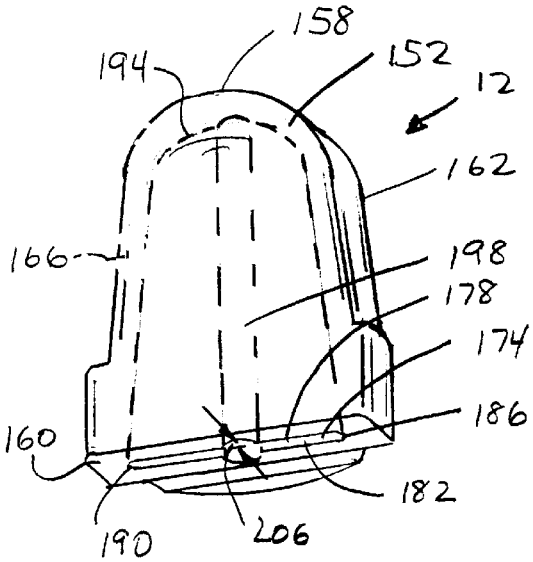
FIG. 12 is a perspective view of a ninth embodiment of the adapter with the body having a vertical channel.

In still another variant, as illustrated in FIG. 12, a cavity 174 in the adapter 12 includes a front wall 178, a back wall 182, first 186 and second 190 side walls and a top wall 194. A vertical channel 198 extends from the bottom surface 160 of the body 152 to the top wall 194 and penetrates for a first predetermined depth 206 into the front wall 178 and the back wall 182 of the cavity 174. When the adapter 12 is installed over the central mounting hook 142 of the dispensing rack 130, the vertical channel 198 will facilitate such installation.

Figure 13:
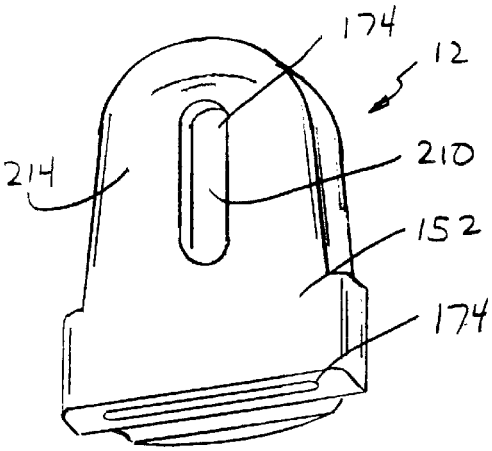
FIG. 13 is a perspective view of a tenth embodiment of the adapter having an opening from the front surface of the body into the cavity.

In a final variant of the invention, as illustrated in FIG. 13, the adapter 12 includes an opening 210. The opening 210 penetrates from the front surface 156 of the body 152 to the cavity 174 and serves to release air pressure as the adapter 12 is fitted over the central mounting hook 142.

The adapters for dispensing rack for T-shirt style bags with rupturable tab opening 10 and 12 has been described with reference to particular embodiments. Other modifications and enhancements can be made without departing from the spirit and scope of the claims that follow.

What is claimed is:

1. An adapter for a dispensing rack for T-shirt style bags with tab openings, each of said tab openings providing a rupturable portion of the tab between the tab opening and the bag mouth, said dispensing rack comprising first and second support arms, a central mounting hook disposed between said support arms, and means for maintaining said support arms at a first predetermined elevation and said mounting hook at a second predetermined elevation, said adapter comprising:

a hollow body, said body including a cavity, said cavity being sized and shaped to fit frictionally over said central mounting hook;

said body having a front surface, a top surface, a bottom surface, first and second side edges and a back surface;

said back surface including a vertically oriented tearing ridge; and whereby, when the adapter's cavity is fitted over the central mounting hook with the front surface facing a direction in which the support arms extend and a pack of T-shirt style bags having the tab opening with rupturable portion mounted on the support arms with the tab openings of the bags disposed over the adapter, the tearing ridge will serve to facilitate tearing the rupturable portion of the mounting tab as a bag is removed from the dispensing rack so that the mounting tab will remain attached to the bag.

2. An adapter for a dispensing rack for T-shirt style bags with tab opening as described in claim 1 wherein the top surface is rounded to facilitate mounting the tab openings of the bags over the adapter.

3. An adapter for a dispensing rack for T-shirt style bags with tab opening as described in claim 1 wherein the first and second side edges taper upwardly toward the top surface to facilitate mounting the tab openings of the bags over the adapter and to direct the vertically oriented tearing ridge into the rupturable portion of the mounting tab as bags are mounted on the dispensing rack.

4. An adapter for a dispensing rack for T-shirt style bags with tab opening as described in claim 1 wherein the cavity further comprises:

a front wall, a back wall, first and second side walls and a top wall;

a vertical channel, said channel extending from the bottom surface to the top wall and penetrating for a first predetermined depth into the front wall and the back wall of the cavity; and whereby when the adapter is installed over the central mounting hook of the dispensing rack, the vertical channel will facilitate such installation.

5. An adapter for a dispensing rack for T-shirt style bags with tab opening as described in claim 1 wherein the hollow body further comprises an opening, said opening penetrating from the front surface to the cavity and serving to release air pressure as the adapter is fitted over the central mounting hook.

6. An adapter for a dispensing rack for T-shirt style bags with tab openings, each of said tab openings providing a rupturable portion of the tab between the tab opening and the bag mouth, said dispensing rack comprising first and second support arms, a central mounting hook disposed between said support arms, a horizontal rod connecting said first and second support arms and said central mounting hook and means for maintaining said support arms at a first predetermined elevation and said mounting hook at a second predetermined elevation, said adapter comprising:

a hollow body, said body including a cavity, said cavity being sized and shaped to fit frictionally over said central mounting hook;

said body having a front surface, a top surface, a bottom surface, first and second side edges and a back surface;

said back surface including a vertically oriented tearing ridge; and whereby, when the adapter's cavity is fitted over the central mounting hook with the front surface facing a direction in which the support arms extend and a pack of T-shirt style bags having the tab opening with a rupturable portion mounted on the support arms with the tab openings of the bags disposed over the adapter, the tearing ridge will serve to facilitate tearing the rupturable portion of the mounting tab as a bag is removed from the dispensing rack so that the mounting tab will remain attached to the bag.

7. An adapter for a dispensing rack for T-shirt style bags with tab opening as described in claim 6, wherein the bottom surface of the adapter further comprises:

a transverse channel, said transverse channel being parallel to the bottom surface and sized and shaped to fit frictionally over the horizontal rod connecting said first and second support arms and said central mounting hook; and whereby, when the adapter is installed over the central mounting hook the transverse channel will engage the horizontal rod, thereby further stabilizing the adapter upon the dispensing rack.

8. An adapter for a dispensing rack for T-shirt style bags with tab opening as described in claim 6 wherein the top surface is rounded to facilitate mounting the tab openings of the bags over the adapter.

9. An adapter for a dispensing rack for T-shirt style bags with tab opening as described in claim 6 wherein the first and second side edges taper upwardly toward the top surface to facilitate mounting the tab openings of the bags over the adapter and to direct the vertically oriented tearing ridge into the rupturable portion of the mounting tab as bags are mounted on the dispensing rack.

10. An adapter for a dispensing rack for T-shirt style bags with tab opening as described in claim 6 wherein the cavity further comprises:

a front wall, a back wall, first and second side walls and a top wall;

a vertical channel, said channel extending from the bottom surface to the top wall and penetrating for a first predetermined depth into the front wall and the back wall of the cavity; and whereby when the adapter is installed over the central mounting hook of the dispensing rack, the vertical channel will facilitate such installation.

11. An adapter for a dispensing rack for T-shirt style bags with tab opening as described in claim 6 wherein the hollow body further comprises an opening, said opening penetrating from the front surface to the cavity and serving to release air pressure as the adapter is fitted over the central mounting hook.

* * * * *